United States Patent [19]

Grommes et al.

[11] 4,299,196

[45] Nov. 10, 1981

[54] RADIUS DRESSER

[75] Inventors: John J. Grommes, Farmington Hills; Karl H. Bekemeier, St. Clair Shores, both of Mich.

[73] Assignee: Tru-Par, Inc., Warren, Mich.

[21] Appl. No.: 152,455

[22] Filed: May 22, 1980

[51] Int. Cl.[3] ..... B24B 53/12

[52] U.S. Cl. ..... 125/11 AT; 125/11 A; 125/11 TP

[58] Field of Search ..... 125/11 R, 11 M, 11 T, 125/11 AT, 11 A, 11 ST

[56] References Cited

U.S. PATENT DOCUMENTS

| | | | |
|---|---|---|---|
| 2,068,611 | 1/1937 | Schuberg | 125/11 M |
| 2,930,373 | 3/1960 | Jessup et al. | 125/11 TP |
| 3,120,723 | 2/1964 | Jessup | 125/11 AT |
| 3,378,001 | 4/1968 | Parapetti | 125/11 R |

*Primary Examiner*—Harold D. Whitehead

*Attorney, Agent, or Firm*—Robert G. Mentag

[57] ABSTRACT

A radius dresser apparatus for cutting concave, convex, or zero radii in the peripheries of surface grinding wheels. A base plate supports a pair of spaced apart vertical support plates, between which is an angularly adjustable, vertically disposed U-shaped carrier member. The U-shaped carrier member has an arcuate bight portion and two integral vertical, upwardly extended, arm portions. A cross arm is slidably mounted on the upper end of each of the carrier member vertical arm portions. The inner ends of each of the cross arms are releasably connected together, and to a forwardly extended, horizontal cutting diamond carrier member which has adjustably mounted at its front end a vertically disposed cutting diamond. The angularity between the cross arms determines the type and degree of radius which the radius dresser will cut into the periphery of a surface grinding wheel, and it is adjustable by means of a releasable locking device that locks the inner ends of the cross arms together in a predetermined angular relationship relative to each other.

8 Claims, 7 Drawing Figures

RADIUS DRESSER

BACKGROUND OF THE INVENTION

1. Field of the Invention

This invention relates to the grinding machine art, and more particularly to a novel and improved radius dresser apparatus for cutting concave, convex, or zero radii in the peripheries of surface grinding wheels. The invention is specifically concerned with a grinding wheel radius dresser for dressing large radii on the peripheries of surface grinding wheels.

2. Description of the Prior Art

It is well known in the surface grinding machine art to provide apparatuses for dressing surface grinding wheels with a radius of up to about four and one half inches. However, a disadvantage of the prior art radius dresser apparatuses is that they are not capable of dressing a radius larger than approximately four and one half inches. Heretofore, in order to dress a radius larger than four and one half inches, it has been necessary to use large extension arms on the prior art radius dresser machines, as well as using layout templates and other means, or even dressing desired large angles on a grinding wheel by hand. An example of such a prior art radius dresser apparatus for grinding wheels operated in connection with surface grinding machines is illustrated in U.S. Pat. No. 2,602,439. Other examples of prior art grinding wheel radius dressers are shown in U.S. Pat. Nos. 2,432,335; 2,622,580; 2,642,059; 2,665,681; 2,850,849; 2,862,493; 2,984,234; 3,009,455; 3,815,569; 3,830,215; and 4,004,568.

SUMMARY OF THE INVENTION

The radius dresser of the present invention is capable of cutting a concave, convex or zero radii in the periphery of a grinding wheel. In accordance with the present invention, the radius dresser comprises a base plate, on which is fixedly mounted a pair of spaced apart vertical support plates. A vertically disposed, U-shaped carrier member is adjustably mounted between the pair of vertical support plates. The U-shaped carrier member includes an arcuate lower end bight portion, and two integral and upwardly extended vertical arm portions. A cross arm is slidably mounted on the upper end of each of the carrier member vertical arm portions. The inner ends of the cross arms are releasably connected together. A horizontal cutting diamond carrier member is releasably connected to the inner ends of the cross arms, and it has a vertically disposed cutting diamond adjustably mounted in a vertical bore in the outer end thereof. The angularity between the cross arms determines the type of degree of radius which the radius dresser will cut into the periphery of a grinding wheel. A releasable locking means locks the inner ends of the cross arms to the inner end of the diamond carrier member in a predetermined angular relationship. A set-up means is provided for setting the angularity of the cross arms.

DESCRIPTION OF THE PREFERRED EMBODIMENT

Figure 1:
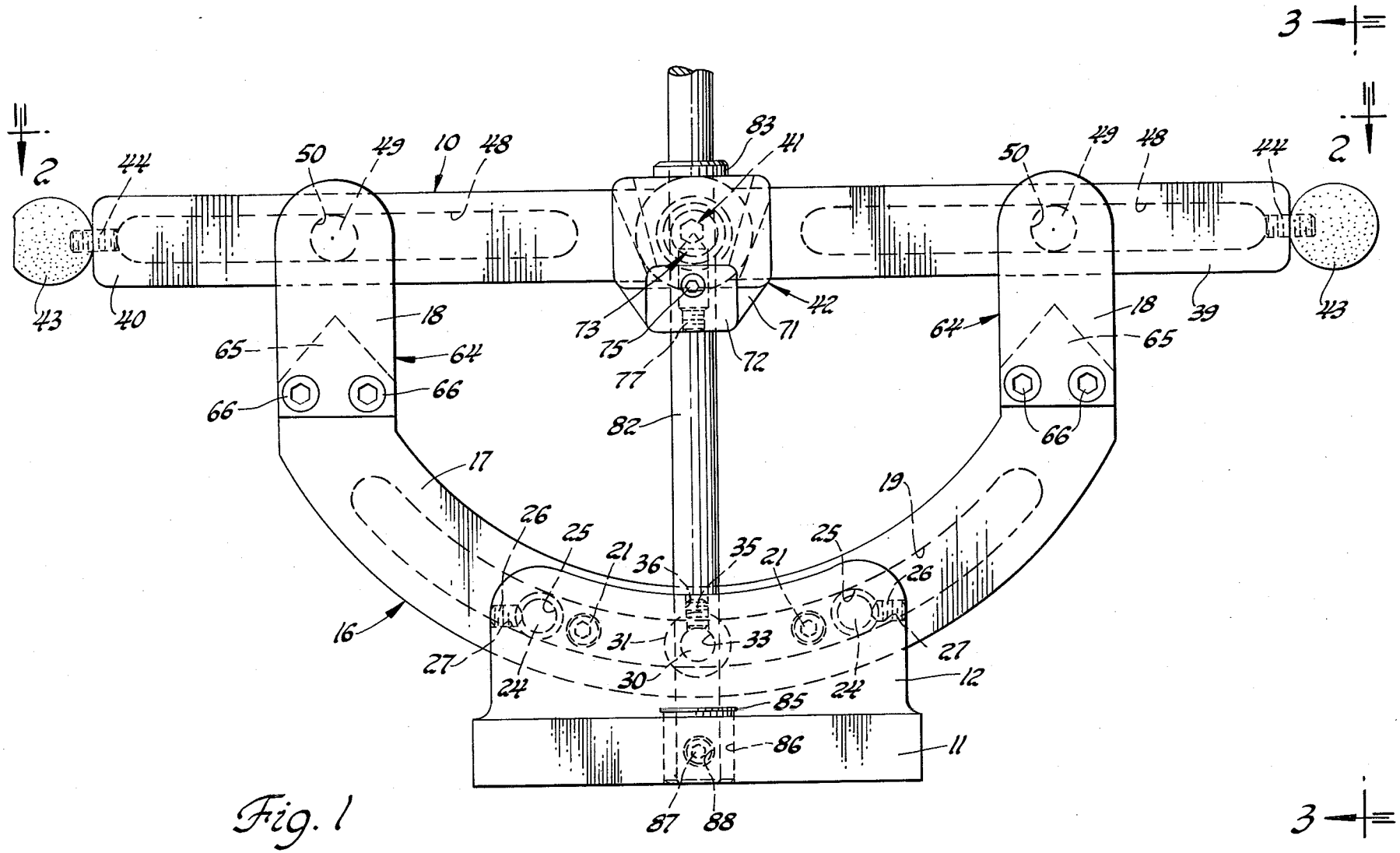
FIG. 1 is a front elevation view of a surface grinding wheel radius dresser made in accordance with the principles of the present invention.
Figure 2:
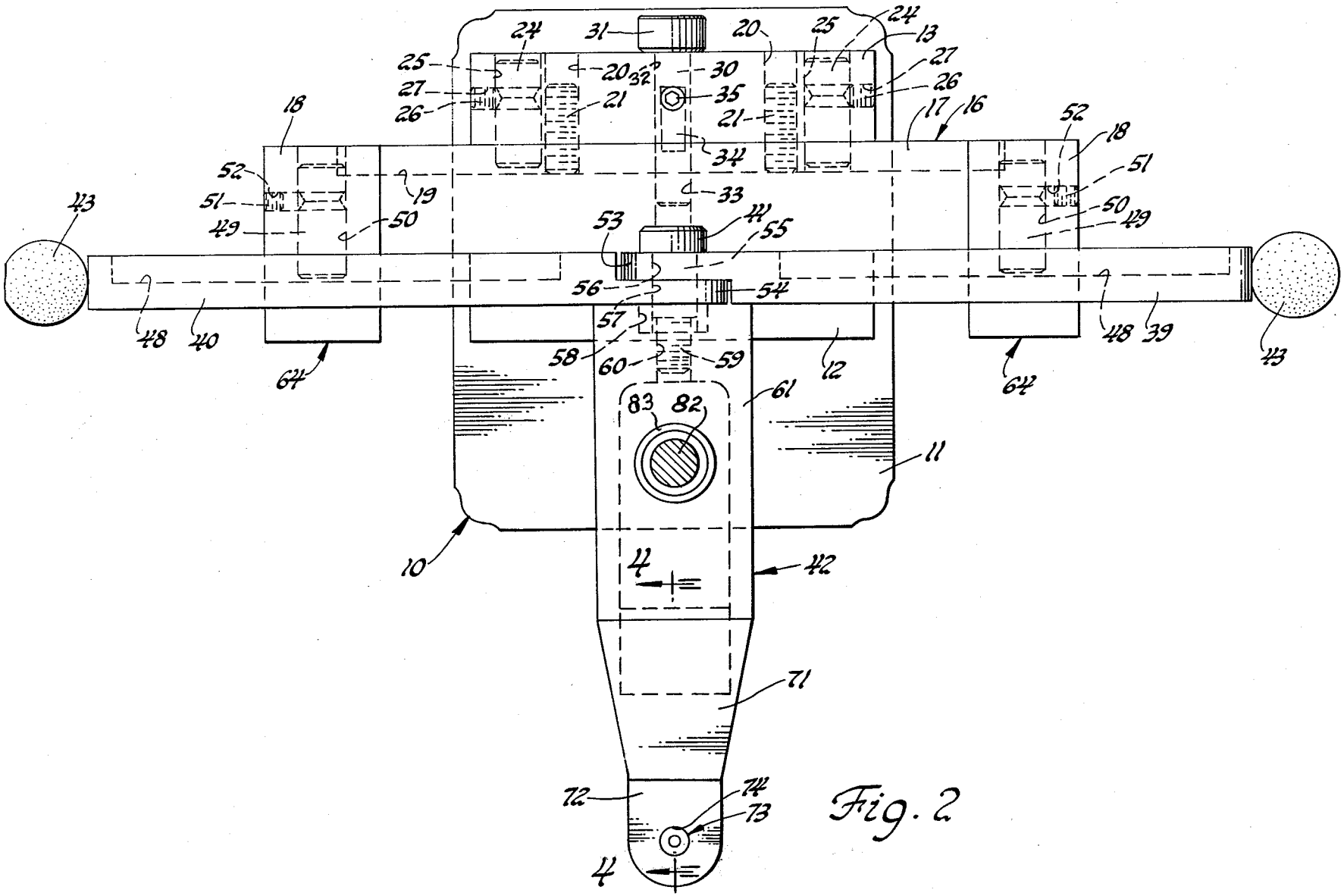
FIG. 2 is a top plan view of the surface grinding wheel radius dresser illustrated in FIG. 1, taken along the line 2—2 thereof, and looking in the direction of the arrows.
Figure 3:
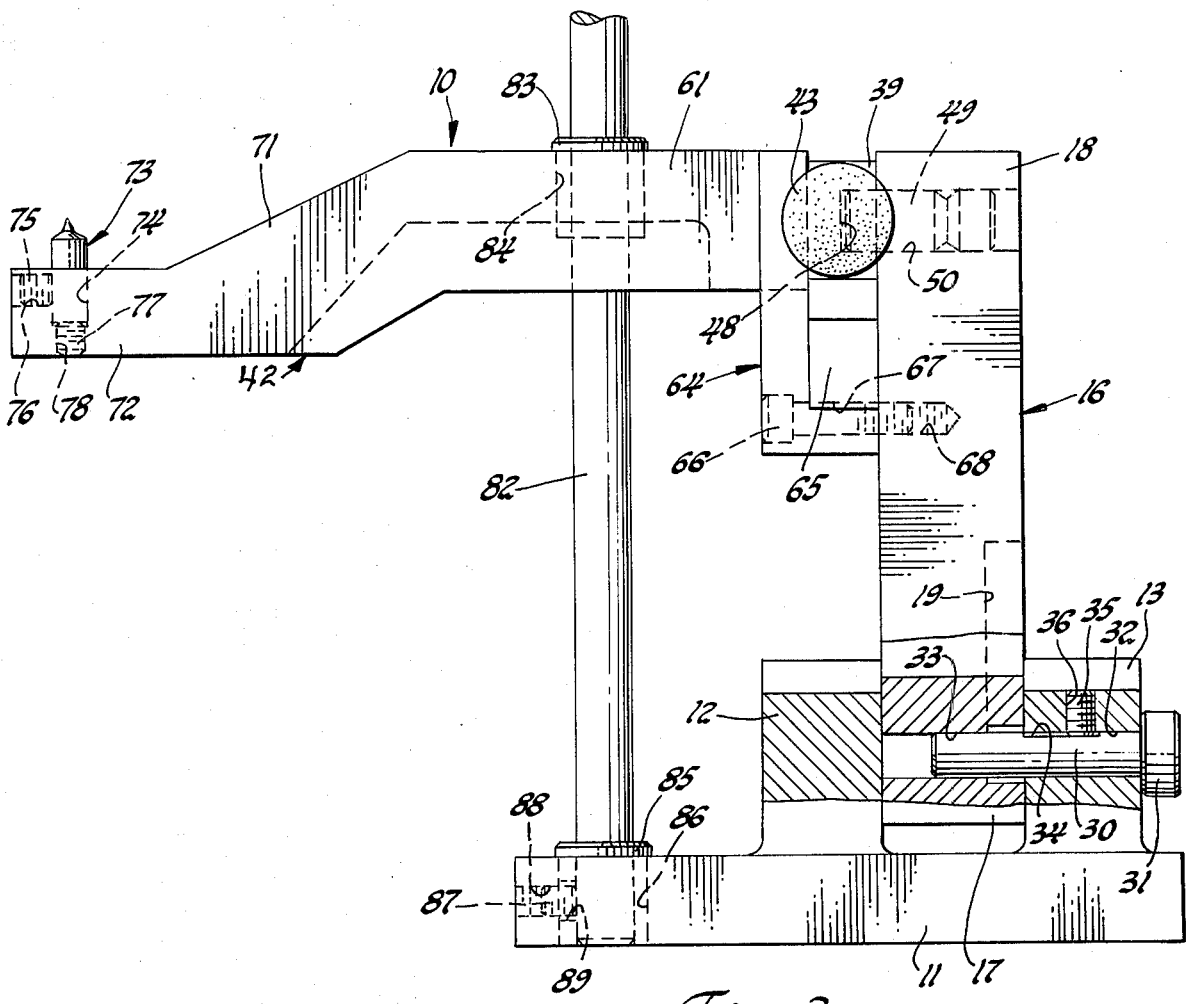
FIG. 3 is a right side elevation, with parts shown in section, of the surface grinding wheel radius dresser illustrated in FIG. 1, taken along the line 3—3 thereof, and looking in the direction of the arrows.

Referring now to the drawing, and in particular to FIGS. 1, 2 and 3, the numerals 10 generally designate a surface grinding wheel radius dresser made in accordance with the principles of the present invention. The radius dresser 10 includes a base plate 11, on the upper end of which is fixedly mounted, by any suitable means, as by welding, a pair of laterally spaced apart front and rear vertical support plates 12 and 13, respectively. As shown in FIGS. 1, 2 and 3, the numeral 16 generally designates a U-shaped carrier member which has an arcuate bight portion 17 and two integral vertical arm portions 18. The arcuate bight portion 17 of the carrier member 16 is adjustably mounted between the vertical mounting plates 12 and 13 by the following described structure.

As best seen in FIG. 3, the bight portion 17 of the carrier member 16 is slidably mounted between the inner faces of the vertical mounting plates 12 and 13. As shown in FIGS. 1, 2 and 3, the carrier member bight portion 17 has a longitudinally, and inwardly extended arcuate guide slot 19 formed along the rear face thereof. As shown in FIGS. 1 and 2, the carrier member 16 is retained in a desired adjusted position by a pair of horizontal set screws 21 which are threadably mounted in suitable threaded holes 20 formed through the rear vertical mounting plate 13. The set screws 21 have their inner end abutting the inner vertical surface of the arcuate guide slot 19 when they are in the locked position, as shown in FIG. 2. As shown in FIGS. 1 and 2, a pair of dowel pins 24 are operatively mounted in suitable bores 25 formed through the rear vertical mounting plate 13. The inner ends of the dowel pins 24 are slidably engaged in the arcuate guide slot 19 formed in the bight portion 17 of the carrier member 16. The dowel pins 24 are each retained in their operative position by a set screw 26 which is threadably mounted in a suitable threaded bore 27 formed in each end of the rear vertical mounting plate 13.

The U-shaped carrier member 16 is maintained in a dead center position by a locking pin 30 which has an enlarged head 31. As best seen in FIG. 3, the locking pin 30 is seated in a bore 32 formed through the rear vertical support plate 13. The inner end of the locking pin 30 is slidably mounted in an aligned bore 33 which is formed through the central portion of the carrier member bight portion 17. The locking pin 30 is retained in a fixed, releasable position by means of a set screw 35 which is threadably mounted through a vertical bore 36 formed through the rear vertical mounting plate 13. The inner end of the set screw 35 is adapted to engage a flat surface 34 which is formed on the upper side of the locking pin 30.

As best seen in FIGS. 1 and 2, the radius dresser 10 includes a pair of cross arms 39 and 40 which carry a forwardly extended cutting diamond support arm, generally indicated by the numeral 42. The cross arms 39 and 40, and the cutting diamond carrier arm 42, are adjustably secured together at their inner ends by a shoulder lock screw, generally indicated by the numeral 41. Each of the cross arms 39 and 40 is provided at the outer end thereof with a suitable hand knob 43 which is attached to its respective cross arm by any suitable mounting screw 44 (FIG. 1).

As shown in FIGS. 1, 2 and 3, each of the cross arms 39 and 40 is provided with a longitudinal, inwardly extended slot 48 which is formed on the rear face thereof. Each of the cross arms 39 and 40 is slidably supported by a suitable dowel pin 49. As shown in FIGS. 2 and 3, each of the dowel pins 49 is mounted horizontally through a suitable bore 50 which is formed through the upper end of each of the carrier member vertical arm portions 18. The inner end of each dowel pin 49 is slidably mounted in the slot 48 of the adjacent cross arm 38 or 40. Each of the dowel pins 49 is retained in a fixed position by a suitable set screw 51 which is mounted in a threaded bore 52 that is formed through the outer side of each of the carrier member vertical arm portions 18.

As shown in FIG. 2, the inner end of the cross arm 39 is provided with a mounting arm 53 which is half the thickness of the other part of the cross arm 39. The cross arm 40 is provided with a similar mounting arm 54 which mates with the first named mounting arm 53 and overlaps the same. The shoulder lock screw 41 has a first unthreaded portion 55 which is rotatably mounted through the bores 56 and 57 formed through the cross arm mounting arms 53 and 54. The shoulder screw unthreaded portion 55 extends through the arms 53 and 54 and into an enlarged recess 58 formed in the rear end of the body 61 of the cutting diamond carrier member 42. The shoulder locking screw 41 is provided on the outer end of the unthreaded portion 55 with a reduced diameter integral threaded portion 59 which is adapted to be threadably engaged into a threaded bore 60 that is formed in the inner end of the cutting diamond carrier body 61.

As shown in FIGS. 1, 2 and 3, the cross arms 39 and 40 are each retained on the carrier member vertical arm portions 18 by an L-shaped retainer, generally indicated by the numeral 64. As shown in FIG. 3, each of the retainer members 64 includes a lower portion which has an upper pointed end (FIG. 1) and an integral outer portion which extends upwardly and against the outer face of the adjacent cross arm 39 or 40, to form a slot, with the adjacent carrier member vertical arm portion 18, between which one of the cross arms 39 or 40 slides. Each of the retainer members 64 is secured to its respective carrier member vertical arm portion 18 by a pair of suitable machine screws 66 (FIG. 1) which are threadably mounted through holes 67 (FIG. 3) formed in the retainer member 64 and into threaded engagement in suitable bores 68 formed in the adjacent carrier member vertical arm portion 18.

Figure 4:
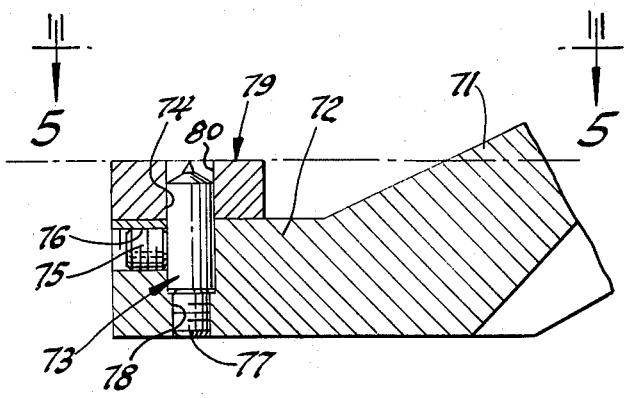
FIG. 4 is a fragmentary, elevation section view of the cutting diamond supporting arm of the radius dresser illustrated in FIG. 2, taken along the line 4—4 thereof, and looking in the direction of the arrows.
Figure 5:
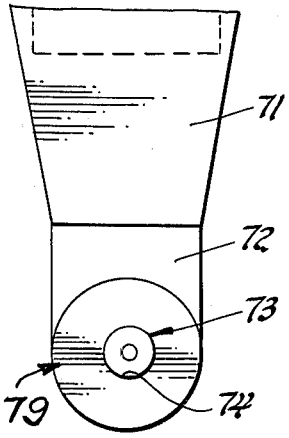
FIG. 5 is a fragmentary, top plan view of the cutting diamond supporting arm structure illustrated in FIG. 4, taken along the line 5—5 thereof, and looking in the direction of the arrows.

As shown in FIGS. 2, 4 and 5, the cutting diamond supporting arm 42 includes a front end body portion 71 which has a downwardly sloping upper face which terminates in the flat horizontal surface of a reduced thickness nose portion 72. A vertically disposed cutting diamond, generally indicated by the numeral 73, is operatively mounted in a vertical bore 74 that is formed through the nose portion 72 of the carrier member 42. The cutting diamond 73 is secured in a desired adjusted position by a set screw 75 which is threadably mounted in a threaded bore 76 that is formed through the front end of the carrier nose portion 72. A threaded bore 78 is formed in the carrier nose portion 72, in alignment with the diamond bore 74, and an adjustment screw 77 is threadably mounted in the threaded bore 78 and it abuts the lower end of the cutting diamond 73 for adjusting the diamond 73 to a desired position in the carrier member hose portion 72. For set-up purposes, a precision collar member, generally indicated by the numeral 79, having an axial bore 80, is adapted to be seated around the upper end of the diamond 73, as shown in FIG. 4. The upper and lower surface of the set-up collar 79 is precision ground to provide an accurate upper surface which can be employed for adjusting the proper height of the cutting tip of the cutting diamond 73 to provide the proper radii to be cut in the periphery of a surface grinding wheel.

As shown in FIGS. 1, 2 and 3, a set-up rod 82 is provided for use in setting the cross arms 39 and 40, for a desired angle to be used in cutting a radius in the periphery of a surface grinding wheel. As best seen in FIG. 3, the set-up rod 82 is slidably mounted through a suitable upper bushing 83 which is fixedly mounted, by any suitable means, in a bore 84 formed through the body 61 of the cutting diamond carrier member 42. The lower end of the set-up rod 82 is adapted to be slidably mounted in a second or lower bushing 85 which is operatively mounted in a bore 86 formed through the base plate 11. The set-up rod 82 is secured in position in the lower bushing 85 by a suitable set screw 87 which is operatively mounted in a threaded bore 88 in the front end of the base plate 11. The inner end of the set screw 87 extends through an enlarged bore 89 formed through the outer wall of the lower bushing 85 and into locking engagement with the lower end of the set-up rod 82.

Figure 6:
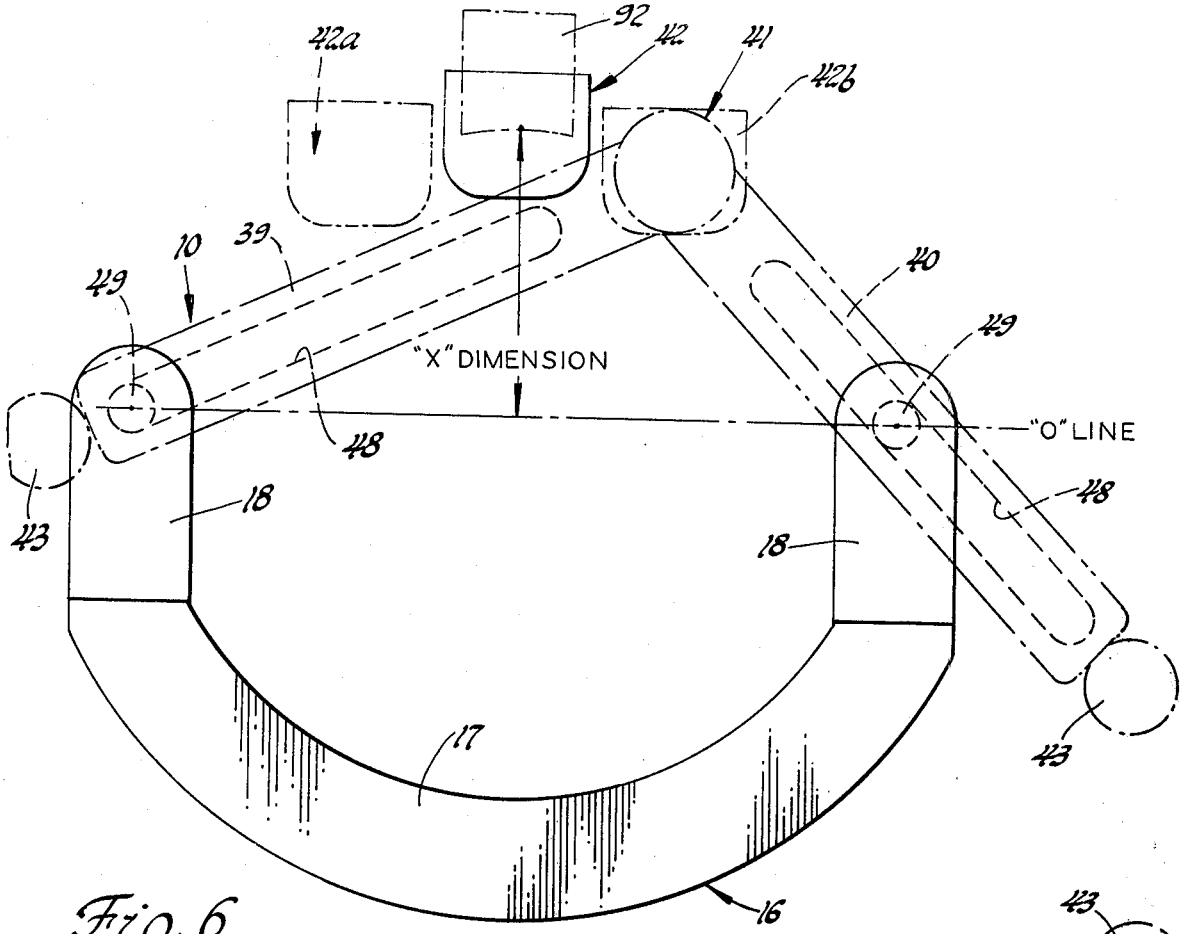
FIG. 6 is a fragmentary elevation view of the radius dresser of the present invention, and showing the cross arms adjusted for dressing a concave radius on the periphery of a surface grinding wheel.
Figure 7:
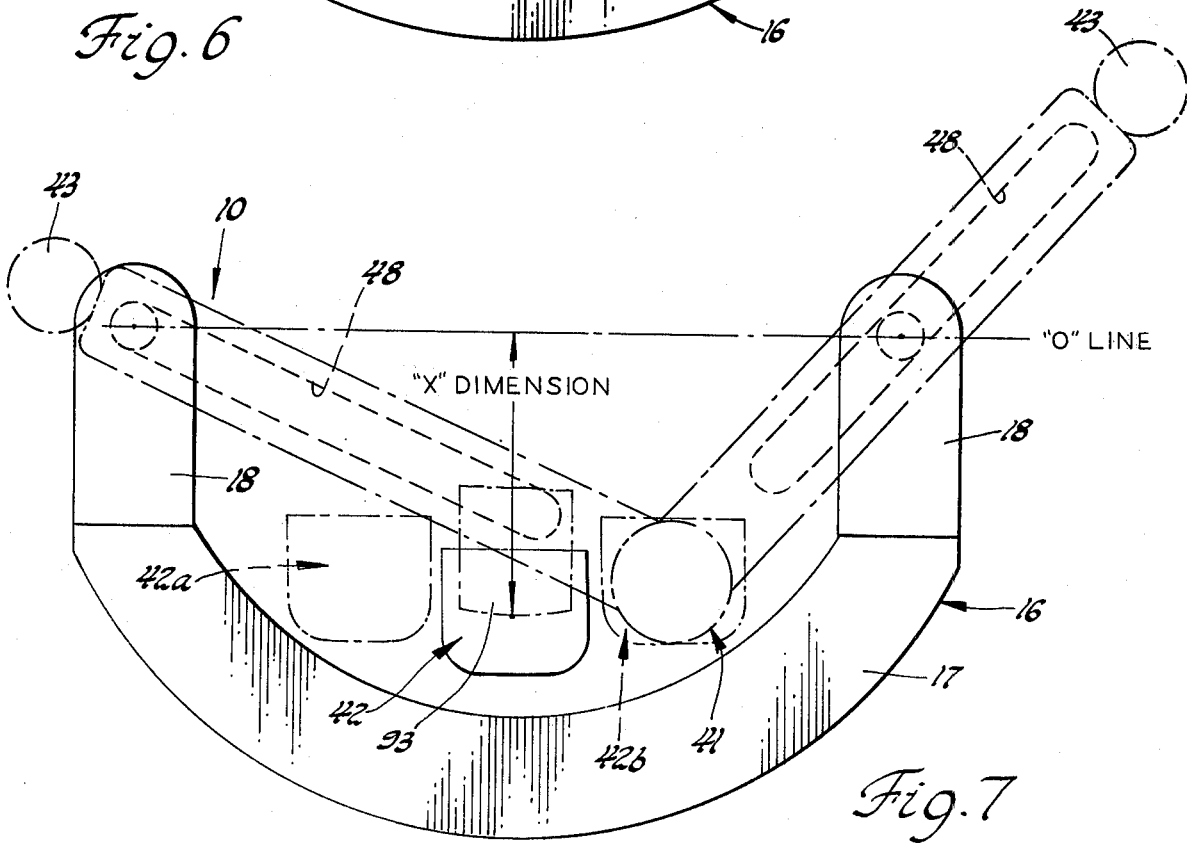
FIG. 7 is a view similar to FIG. 6, of the radius dresser of the present invention, and showing the cross arms adjusted to cut a convex radius on the periphery of a surface grinding wheel.

In use, with the radius dresser 10 in position on the magnetic table of a surface grinding machine, the set-up rod 82 is mounted in the position shown in FIGS. 1, 2 and 3, and the shoulder locking screw 41 is loosened and the cross arms 39 and 40 are moved upwardly or downwardly to a desired angle. It will be understood, that the cutting diamond carrier member 42 also moves upwardly and downwardly when the cross arms 39 and 40 are adjusted. If the cross arms 39 and 40 are set on the "zero" line, which is a horizontal line through the axes of the cross arm pivot dowels 49, as shown in FIGS. 6 and 7, then the cross arms 39 and 40 will be set to cut a "zero" radius on the periphery of a surface grinding wheel. After the cross arms 39 and 40 have been adjusted to a desired angle, the shoulder locking screw 41 is screwed inwardly to lock the cross arms 39 and 40 to the cutting diamond carrier member 42, and the radius dresser is in an operative condition for a radius dressing operation. The distance from the top of the grinding wheel table to the tip of the cutting diamond 73 can be checked with suitable checking instruments, and the set-up collar 79. A "zero" radius can then be cut on the periphery of a surface grinding wheel by moving the radius dresser with the diamond 73 at its proper height, back and forth, transversely, across the periphery of the surface grinding wheel.

In order to cut a concave radius in the periphery of a surface grinding wheel the radius dresser 10 would be positioned with the diamond carrier 42 in the center position, and the set-up rod 82 again installed in its vertical position, as shown in FIGS. 1 through 3. The lock screw 41 is then loosened and the cross arms 39 and 40 are moved to a desired "X" dimension above the "zero" line, as indicated generally in FIG. 6, and when the "X" dimension and the centerline of the locking screw 41 is above the "zero" line a predetermined distance, the lock screw 41 is locked in place and the radius dresser 10 is in condition for cutting a concave radius in the periphery of the surface grinding wheel, then the reverse procedure is carried out so as to move the cross arms 39 and 40 to a position below the "zero" line in the same manner as discussed above for setting a position above the "zero" line. FIG. 7 illustrates the positioning of the cross arms 39 and 40 for producing a convex radius on the periphery of a surface grinding wheel.

As shown in FIG. 6, with the cross arms 39 and 40 positioned for cutting a concave radius, the cutting action is carried out by grasping the knobs 43 and sliding the cross arms 39 and 40 first in one direction and then in the other direction, with the cross arms 39 and 40 being guided in their movements by the dowel pins 49 sliding in the slots 48. It will be seen that the slots 48 face away from the cutting action on a grinding wheel 92, as indicated in FIG. 6, so that the particles of material removed in the cutting action will not clog up the slots 48 so as to injuriously affect the movement of the cross arms 39 and 40 and the cutting diamond carrier member 42. The numeral 42 in FIG. 6 indicates the central position of the cutting diamond carrier member 42, when it is in the central or set-up position, and the numerals 42*a* and 42*b* designate the extreme left and right movements of the cutter carrier member 42 as it is rocked from side to side to produce a concave radius on the periphery of the grinding wheel 92.

FIG. 7 shows a similar arrangement for cutting a convex radius on the periphery of a surface grinding wheel which is indicated by the numeral 93. The numeral 42 again indicates the central or set-up position of the diamond carrier member 42, and the numerals 42*a* and 43*b* designate the extreme left and right positions assumed by the diamond carrier member 42 as it is moved from back and forth to cut the convex radius on the grinding wheel 93. The following listed chart is illustrative of the sizes of radii which may be cut with certain dimensions "X". It will be understood that the below listed chart is merely illustrative of the "X" dimensions and their relationship to the "zero" line, and the radius to be dressed into the periphery of a grinding wheel.

EXAMPLES OF RADIUS IN RELATION TO "X" SETTINGS

| RADIUS | | "X" SETTING |
|---|---|---|
| 5.000" | "x" | = 2.0005 |
| 10.000" | "x" | = .8352 |
| 20.000" | "x" | = .4038 |
| 40.000" | "x" | = .2000 |
| 50.000" | "x" | = .1600 |
| 100.000" | "x" | = .0810 |
| 500.000" | "x" | = .0150 |

-continued

EXAMPLES OF RADIUS IN RELATION TO "X" SETTINGS

| RADIUS | | "X" SETTING |
|---|---|---|
| 1000.000" | "x" | = .0100 |

It has been found that the radius dresser 10 of the present invention provides an accurately shaped radius on the periphery of a surface grinding wheel if the "X" dimension is set within 0.0001" when setting up the radius dresser 10 for a dressing operation. The radius dresser 10 of the present invention can be used not only for dressing a large radius on the periphery of a surface grinding wheel, but such large radius may also be dressed in conjunction with angles. That is, by adjusting the position of the U-shaped carrier member 16, relative to the vertical mounting plates 13 and 14, the radius dresser 10 of the present invention can cut a radius more on the side of the periphery of a surface grinding wheel rather than just on the bottom or periphery thereof. The last mentioned function can be carried out to an angle of about 35°. The slot 19 in the rear face of the U-shaped carrier member 16 also protects against dirt gathering in the guide slot 19 and causing adjustment problems.

While it will be apparent that the preferred embodiment of the invention herein disclosed, is well calculated to achieve the result aforestated, it will be appreciated that the invention is susceptible to modification, variation and change.

What is claimed is:

1. A radius dresser for cutting a concave, convex or zero radius on the periphery of a surface grinding wheel, characterized in that the radius dresser includes (a) a base plate;

(b) a carrier member provided with a pair of vertical arm portions;

(c) means for adjustably mounting the carrier member on the base plate;

(d) a pair of cross arms which each have an outer end and an inner end;

(e) means for slidably mounting one of said cross arms on the upper end of each of said carrier member vertical arm portions;

(f) a horizontally disposed cutting diamond carrier member having an inner end and an outer end;

(g) means for pivotally mounting and releasably locking, on a horizontal pivot axis, the inner ends of the cross arms to the inner end of the diamond carrier member, and to each other in a predetermined angular relationship; and, (h) a cutting diamond adjustably mounted in the outer end of the diamond carrier member for cutting engagement with the periphery of a grinding wheel, whereby when the cross arms are slid back and forth axially the cutting diamond will cut a predetermined radius on the periphery of the grinding wheel in accordance with the angular relationship of the cross arms to each other.

2. A radius dresser as defined in claim 1, characterized in that said means for adjustably mounting the carrier member on the base plate includes:

(a) a pair of vertically disposed support plates fixedly mounted on the base plate; and, (b) means carried by said support plates and engaging said carrier member for allowing adjustment of the carrier member along an arcuate path, and for releasably securing the carrier member in an adjusted position along said arcuate path.

3. A radius dresser as defined in claim 1, characterized in that:

(a) said radius dresser includes means for retaining the pivot axis of the inner ends of the cross arms and the diamond carrier member for movement along a vertical plane midway between the vertical arm portions of the carrier member when the angular relationship of the cross arms is adjusted.

4. A radius dresser as defined in claim 3, characterized in that said means for retaining the pivot axis of the inner ends of the cross arms and the diamond carrier member along a vertical plane includes:

(a) a removable, elongated rod slidaby mounted through the diamond carrier member and having the lower end thereof releasably seated in the base plate.

5. A radius dresser as defined in claim 1, characterized in that:

(a) said radius dresser includes a detachably mounted collar member for seating on the diamond carrier member, around the upper exposed cutting point of the diamond cutting tool, to assist in adjusting the position of the diamond relative to the position of the periphery of a grinding wheel which is to be radius dressed.

6. A radius dresser as defined in claim 1, characterized in that:

(a) each of said cross arms is provided with a hand knob on the outer end thereof for grasping each cross arm and sliding the same relative to a carrier member vertical arm portion.

7. A radius dresser as defined in claim 1, characterized in that said means for slidably mounting a cross arm on the upper end of a carrier member vertical arm portion includes:

(a) a longitudinally extended guide slot formed in the rear face of each cross arm; and, (b) a dowel pin mounted in each carrier member vertical arm portion and having an end extended forwardly thereof and into sliding engagement with the guide slot in the adjacent cross arm.

8. A radius dresser as defined in claim 2, characterized in that said means for adjustably mounting the carrier member on the base plate includes:

(a) an arcuate slot formed in the lower end of the carrier, on the rear face thereof; and, (b) dowel pin means mounted in one of said support plates and extended into the arcuate guide slot in the carrier member.

* * * * *